United States Patent [19]

Hijuelos et al.

[11] 4,441,238

[45] Apr. 10, 1984

[54] CONTINUOUS PRODUCTION OF POLISHED AND BUFFED TUBING

[75] Inventors: Humberto Hijuelos, East Hazelcrest; Giulio Scartozzi, Chicago Heights; Lawrence P. Vollmuth, Wheaton; Raffaele Basile, Chicago Heights, all of Ill.

[73] Assignee: Allied Tube & Conduit Corporation, Harvey, Ill.

[21] Appl. No.: 232,469

[22] Filed: Feb. 9, 1981

[51] Int. Cl.[3] ..... B08B 9/02; B21C 37/00

[52] U.S. Cl. ..... 29/33 D; 15/88; 15/104.04; 29/527.4; 51/80 A

[58] Field of Search ..... 29/33 D, 527.4, 157 T, 29/781; 51/74 R, 80 A, 81 R; 15/88, 104.04

[56] References Cited

U.S. PATENT DOCUMENTS

| | | | |
|---|---|---|---|
| 1,056,403 | 3/1913 | Crane | 15/104.04 X |
| 1,751,094 | 3/1930 | Matteson . | |
| 1,941,002 | 12/1933 | Harrison | 15/88 X |
| 2,158,400 | 5/1939 | Chamberlin | 29/33 D |
| 2,353,125 | 7/1944 | Carpmail | 15/88 |
| 2,680,938 | 6/1954 | Peterson | 15/88 X |
| 3,122,114 | 2/1964 | Krengel et al. | 29/33 D X |
| 3,230,615 | 1/1966 | Krengel et al. | 29/33 D |
| 3,667,095 | 6/1972 | Ostrowski et al. | 29/33 D |
| 3,820,184 | 6/1974 | Stone | 15/104.04 |
| 3,889,427 | 6/1975 | McCoy | 51/80 A |
| 3,895,463 | 7/1975 | Brandli et al. | 15/88 X |

*Primary Examiner*—Z. R. Bilinsky

*Attorney, Agent, or Firm*—Fitch, Even, Tabin & Flannery

[57] ABSTRACT

Apparatus is provided for the continuous production of tubing from steel strip. The formed tubing is continuously advanced along a straight-line path through polishing and buffing units to provide a smooth lustrous finish to the tubing, and through a coating chamber in which the tubing is coated with a polymer coating to prevent tarnishing of the lustrous polished surface. The finished tubing has a surface which is suitble for decorative applications such as furniture or the like.

5 Claims, 5 Drawing Figures

CONTINUOUS PRODUCTION OF POLISHED AND BUFFED TUBING

This invention relates to apparatus for the continuous forming, polishing and buffing of thin-walled metal tubing and it relates more particularly to the production of polished thin-walled tubing from metal strip.

BACKGROUND OF THE INVENTION

Apparatus is described in U.S. Pat. No. 3,230,615 issued Jan. 25, 1966 to Krengel et al. for producing thin-walled metal tubing from metal strip wherein the tubing is further treated by galvanizing and sizing. The continuous production of thin-walled metal tubing from metal strip has significantly reduced the cost of tubing, such as that commonly used as electrical conduit. The zinc layer provides resistance to corrosion and subsequent long life.

It has become increasingly popular in recent years to use metal tubing in decorative items such as art objects, lamps, furniture, etc. In such objects, tubing is generally used which has a lustrous or semilustrous finish to give an attractive appearance to the object. To this end, electroplated zinc, aluminum, chromium-plated tubing and stainless steel tubing are commonly used in indoor or outdoor furniture, lamps, toys, appliances, etc. However, the cost of such tubing is much higher than hot dip-metal coated tubing, such as galvanized tubing.

While hot dip metal coated tubing, such as galvanized tubing used as electrical conduit, has a rough functional surface appearance and is thus inappropriate for use in decorative items, such tubing may be polished to have an attractive lustrous finish appropriate for decorative use. In order to maintain the cost advantage that such tubing has over other decorative tubing, it is necessary that a decorative finish be given to the tubing as a part of the continuous forming line.

Accordingly, it is an object of this invention to provide apparatus where tubing is formed from metal strip and polished to provide a finish which is suitable for decorative use.

SUMMARY OF THE INVENTION

Apparatus is provided wherein metal strip is formed into thin-walled tubing by forming rolls, seam-welded, scarfed, and then prepared for hot dip-metal coating by cleaning and preheating. After leaving the molten metal bath and being cooled, the coated tubing is passed through units wherein the tubing is polished and buffed to a lustrous finish. In order to protect the finish from tarnishing, a coating unit applies a polymer coating to the tubing which is dried or cured before the tubing is cut to desired lengths.

DETAILED DESCRIPTION OF THE PREFERRED EMBODIMENTS

In accordance with the present invention, apparatus is provided by which tubing is formed from metal strip, polished and buffed as it continuously advances along a straight-line path.

Figure 1:
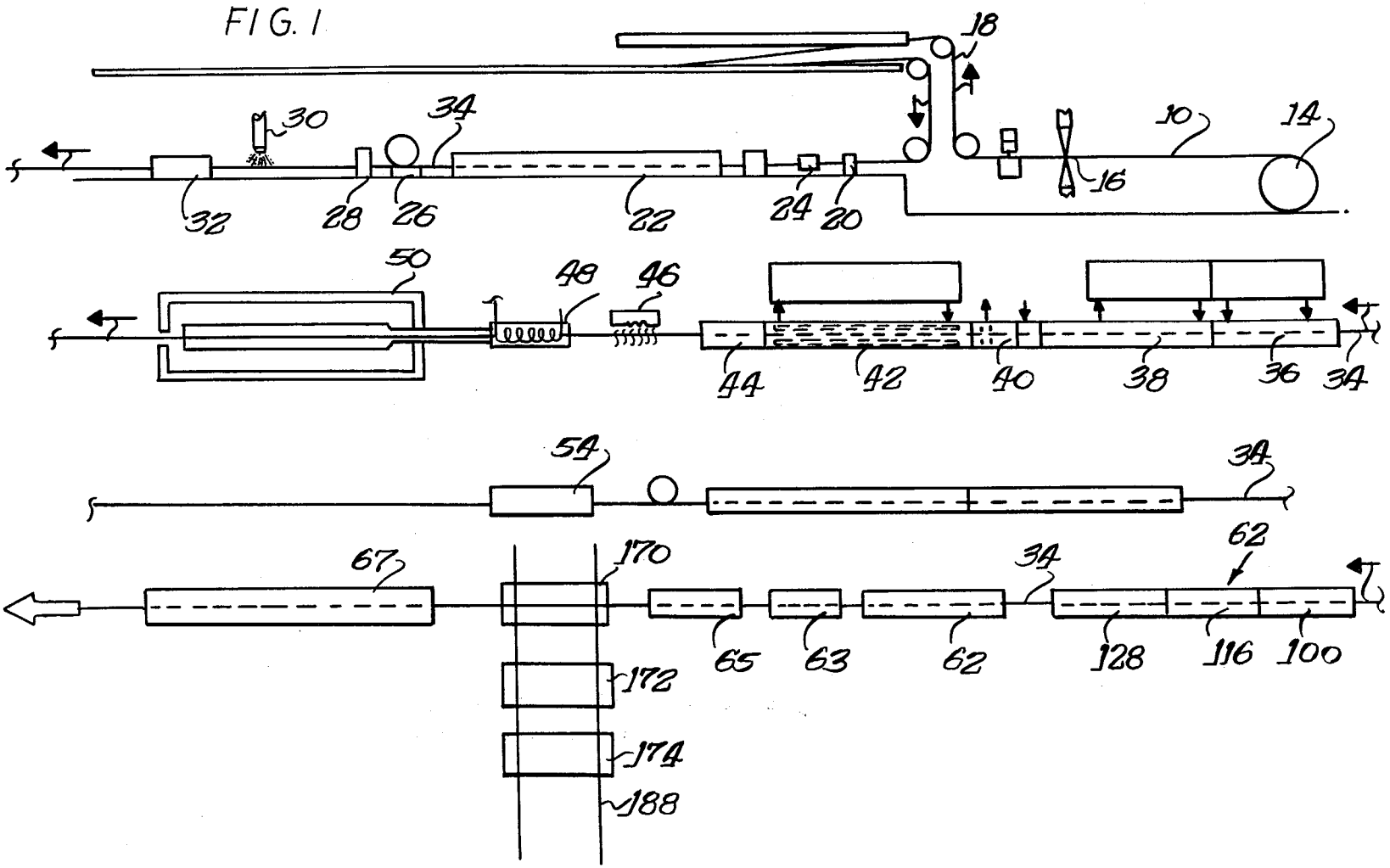
FIG. 1 is a diagrammatic illustration of a line, embodying various features of the present invention, in which tubing is formed, coated, polished and buffed.

To illustrate the invention, a line of apparatus is shown in FIG. 1 in which tubing is galvanized, and the zinc coating is polished and buffed to a lustrous finish. Metal strip 10 is unrolled from reels 12 mounted for rotational movement on a stand 14. The strip 10 is advanced to an end joiner unit 16 and a take-up unit 18 where strip from one reel is appropriately joined to strip from a successive reel so that the tubing may be formed as a continuous process.

The strip 10 advances to an edge shaver 20 wherein the lateral edges of the strip are trimmed to reduce the strip to its appropriate width and to present freshly cut metal to the subsequent welding operation after the edges are brought together by the tube-forming rolls 22.

From the edge trimmer 20, the strip 10 advances to a wiper 24 to remove metal fragments and into a bank of tube-forming rolls 22. The tubing 34 advances to a seam welder 26 to join the edges, a seam shaver 28 to scarf rough particles from the welded tubing, a water cooling spray 30, and an optional heliarc welder or any suitable type of welding equipment 32 to reinforce the seam and to weld any discontinuities in the seam.

The formed tubing 34 advances to a cleaning section whereat oxide, grease, etc. are removed from the surface of the metal tubing to prepare the tubing for subsequent galvanizing. The tubing advances through a strong alkali wash 36, a medium alkali wash 38, and a water rinse 40. The tubing 34 is pickled by a spray of acid in an acid pickling tank 42 to prepare the surface for galvanizing. Subsequently, a water rinse 44 rinses off the excess acid.

The welded and cleaned tubing 34 then advances from the cleaning section to a steam blast 46 for further cleaning and then to an induction heating chamber 48 to remove any remaining moisture from the surface of the tubing and to preheat the formed tubing to a temperature suitable for entry into the vat 50 of molten zinc in which the tube is galvanized. The induction heating unit 48 and the zinc vat 50 are maintained under an inert atmosphere to minimize oxidation.

The galvanized tubing 34 advances through a water cool down section 52 which cools down the tubing before it is advanced to an optional sizing unit 54 where sizing rollers assure that the tubing 34 has its desired exterior diameter.

The sized tubing 34 advances through a tube polishing section 60 with one or more polishing units and a buffing unit 61 to provide the desired lustrous surface to the tubing. The tubing is passed through a cleaner 62 where it is washed with a low alkalinity liquid cleaner and a rinser 63, or the tubing may be passed through other types of cleaning apparatus where it is cleaned by solvents, ultrasound etc. The cleaned tubing 34 advances through a chromate passivating unit 65 where the coating is rendered less chemically active. To protect the surface against subsequent oxidation, the polished tubing 34 is thereafter passed through a coating unit 64 wherein a polymer coating is applied to the surface. After the polymer is cured or set, the polished coated tubing 34 is advanced to a traveling shear unit 67 which cuts the tubing into its desired length.

Figure 2:
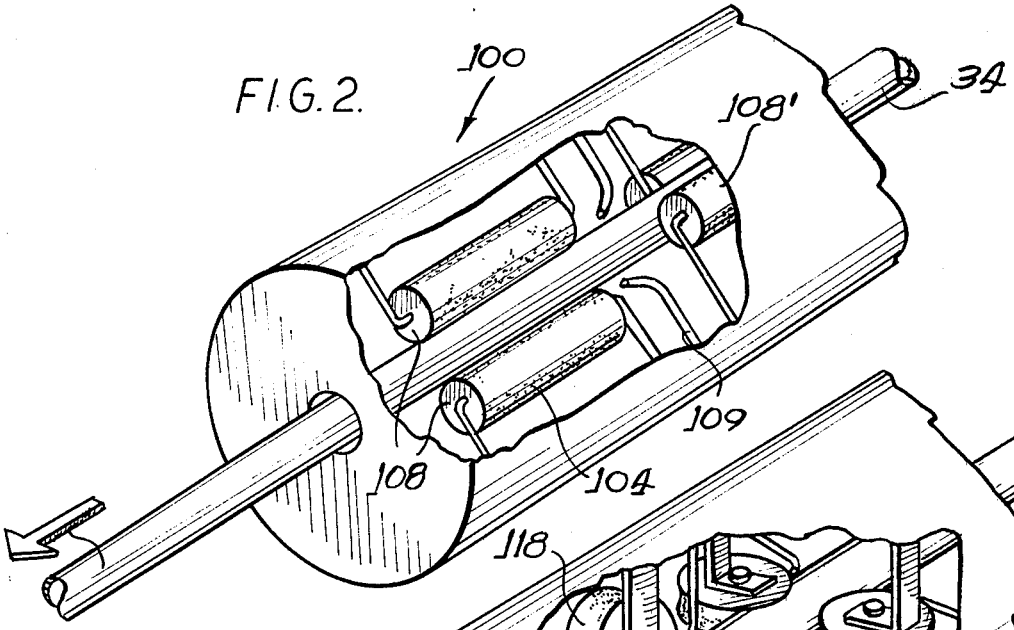
FIG. 2 is a perspective view, partially cut away, of a tubing polishing unit in which polishing brushes radially contact the tubing passing therethrough.

Illustrated in FIG. 2 is a polishing unit 100 through which round galvanized tubing 34 travels. The unit 100 has generally cylindrical housing 102 and a plurality of polishing brushes 104 which are mounted from the interior wall for rotation in radial contact with the surface of the tubing 34. As it is necessary that the tubing 34 be polished over the entirity of its exterior surface, brushes 104 are disposed around the path of the tubing. At a plurality of points along the path of tubing travel, a pair 108 of opposed polishing brushes 104 radially contact the tubing 34. Each brush 104 is mounted to press against the traveling tubing. In the apparatus illustrated in FIG. 2, each brush 104 polishes at least a 90° arc in the tubing and a second pair 108' of brushes mounted perpendicularly thereto polish the remainder of the surface. To achieve a more uniform polished surface, it is preferred that the polishing units include additional brushes mounted at various angles around the tubing 34 to provide sufficient overlap of the arcuate polished bands. Nozzles 109 associated with at least the first four brushes 104 which contact the tubing 34 apply an abrasive polishing compound either directly to the tubing or to the brushes. Depending on various factors, such as the width of the brushes 104 and their speed of rotation, it may be desirable that a plurality of polishing units 100 be aligned with the path of the tubing 34. The aligned polishing units 100 preferably have brushes 104 which provided a gradient of abrasiveness so that the tubing 34 is more finely polished in each successive polishing unit 100.

Figure 3:
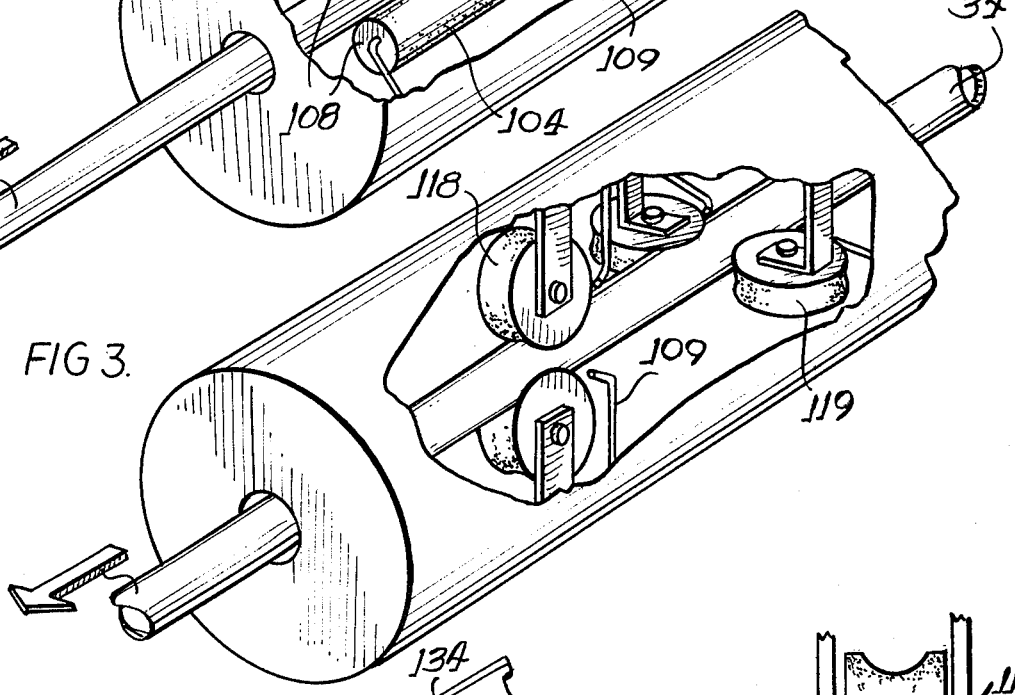
FIG. 3 is a perspective view, partially cut away, of a further type of tubing polishing unit in which the polishing brushes tangentially contact the tubing passing therethrough.
Figure 4:
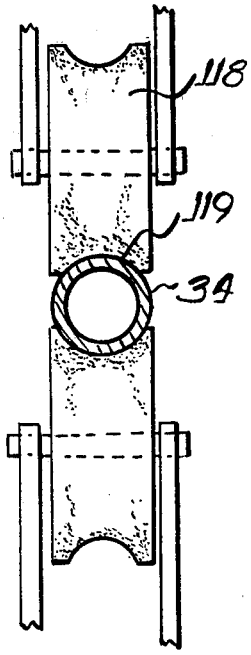
FIG. 4 is an enlarged end view of a brush used in the unit shown in FIG. 3 in contact with the tubing.

Illustrated in FIG. 3 is a polishing unit 116 having a plurality of polishing brushes 118 mounted around the path of tubing 34 for rotation in tangential contact therewith. As seen in FIG. 4, each brush 118 is disc shaped with a concave arcuate polishing edge 119 substantially matched to the curvature of the tubing 34. Sufficient brushes are mounted at various angular positions relative to the tubing so that the polishing is continuous around the entire exterior surface.

Figure 5:
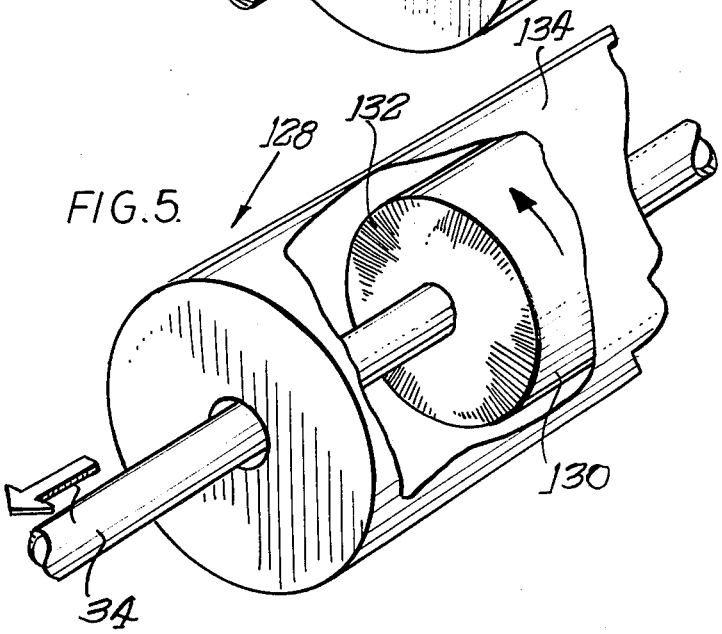
FIG. 5 is a cutaway perspective view of a buffing unit.

Illustrated in FIG. 5 is a buffing unit 128 in which a cylindrical drum 130 is lined with a plurality of buffing pads 132 which carry a fine abrasive such as a rouge. Each pad extends along an arcuate portion of the interior wall of the drum. The drum 130 is aligned in the path of tubing 34 travel and is mounted for rotation in a housing 134 so that the pads 132 polish the tubing 34 passing therethrough. The pads 132 contact a total of at least 240°, and preferably at least 320°, of the tubing surface at all times, and uniformly buff the surface of tubing 34 to a final highly polished finish.

Generally several polishing units are aligned with the path of tubing travel to achieve the desired lustrous finish. Typically, different types of polishing units are aligned. For example, as shown in FIG. 1, the galvanized tubing 34 may first be passed through a unit 100 of the type shown in FIG. 2 in which a plurality of brushes 104 mounted at various angular positions relative to the tubing 34 polish the tubing with a rough abrasive. Thereafter, the tubing 34 advances through a unit 116 as shown in FIG. 3 in which brushes 118 rotate in tangential contact with the tubing to polish the tubing with a finer abrasive. The reverse order, in which the tangential polishing unit 116 precedes the radial polishing unit 100, may also be employed. The units 100, 116 may be alternated so that polishing patterns characteristic of each type of brush contact will tend to be cancelled at each step where a finer abrasive is used.

The tubing 34, emerging from the buffing section 61 with its polished metallic coating, as a smooth, lustrous finish which in the case of zinc has the bluish-white color characteristic of freshly applied zinc. The bluish-white color of the finished tubing 34, if exposed to the atmosphere, particularly humid atmosphere, will quickly tarnish leaving the tubing with the gray color commonly associated with galvanized tubing. As the bluish-white color of metallic zinc is generally preferable for decorative purposes to the gray of tarnished zinc, it is necessary to protect the surface from oxidation. Accordingly, the surface is coated with a suitable polymer which protects the surface. The coating cooperates with the polished metal surface to give the tubing its final surface appearance. A clear polymer may enhance the brightness of the polished coating. A translucent coating may give the tubing a satiny finish. Dyed lacquers may be used to color the tubing. The polymer coating should be sufficiently durable to provide long-term protection for the zinc surface. As the tubing 34 may be later bent for forming furniture or the like, the polymer should have sufficient elasticity to fully cover the surface of the tubing even if the tubing is bent. One such suitable polymer for coating a polished galvanized surface is acrylic polyurethane.

The polymer coating chamber 64, through which the tubing 34 is passed subsequent to polishing, is appropriate for applying the particular coating and may take the form of a bath in which the tubing is submerged in a liquid polymer coating. Preferably, however, the tubing 34 is passed through a coating unit 64 in which sprays of coating polymer are directed at the tubing to provide a generally uniform coating thereto. Electrostatic spraying may be advantageously used to apply the polymer.

Subsequent to coating, the tubing 34 is passed through a curing unit appropriate to set the particular polymer on the tubing surface. A powder coating may be melted onto the tubing in a heating unit 170 (FIG. 1). Liquid polymer coatings may be set by evaporating away the solvents in a drying chamber 172 through which carrier gas flows. Other polymers may be cured by radiation in a unit 174 containing appropriate lamps or other sources of radiation. Various curing units may be placed on wheeled platforms for movement along a track 188 which runs transverse to the path of tubing 34, so that the units may be alternately aligned with the path of travel of the tubing for curing alternate coatings.

The present invention adapts a line of apparatus in which galvanized tubing is continuously and inexpensively produced from strip metal, to the production of tubing having an attractive finish suitable for furniture, decorative purposes, etc. The adaption of the line of apparatus is accomplished with additional apparatus which neither significantly adds to the cost of the finished tubing nor interferes with the smooth flow of the line in which galvanized tubing is produced from strip metal. The polishing, buffing, coating and curing units are provided on-line with the tube-forming apparatus so that the efficiencies of continuous tube forming are retained.

The attractive zinc surface provided by the line of apparatus has its own distinctive characteristics and is comparable aesthetically with commonly used ornamental metal tubing. Because the tubing is inherently cheaper to produce than commonly used tubings such as chrome plate tubing or stainless steel tubing, it is contemplated that the tubing produced by the described apparatus will be widely applicable for use in furniture, lamps, and other indoor or outdoor decorative applications. Furthermore, because the apparatus herein described provided tubing which is only slightly more expensive than tubing commonly used to form unfinished galvanized conduit tubing, it is envisioned that architectural applications will be found where it is desirable or necessary that electrical conduit remain exposed.

While the present invention is particularly directed to providing a lustrous finished surface for ornamental application, for certain ornamental applications, a grey pewter-like finish may be preferable to a lustrous surface. For such purpose, the polished tubing may be left uncoated so that it will oxidize.

The lustrous finish may optionally be provided with a brush semilustrous finish by appropriately abrading the tubing to form a pronounced line effect in the direction of the tubular axis.

While for illustration purposes, apparatus has been described in which a zinc coating is applied to the tubing, other surfaces may be similarly polished and buffed to provide lustrous finishes on continously formed tubing. The tubing may be hot dipped in other molten metals such as aluminum, aluminum alloys, tin, etc. Continuous polishing and buffing may be used to finish uncoated tubing formed of certain metals such as steel which may be provided with either a polished or satin finished. Each different type of tubing, of course has its own requirements and the number of polishing units, the speed of the brushes, the type of abrasive etc., is adjusted accordingly.

The tubing may have a square as well as a round configuration. Preferably polishing and buffing brushes used with square tubing will contact each edge of the tubing tangentailly and have flat polishing edges.

While the invention has been described in terms of certain preferred embodiments, modifications obvious to one skilled in the art may be made without departing from the scope of the invention.

Various features of the invention are set forth in the following claims.

What is claimed is:

1. Apparatus for continuously forming tubing from metal strip and providing a decorative finish thereto as it travels along a straight-line path including, in sequence, means for continuously supplying metal strip, forming rolls, a seam welder, scarfing means for treating said seam weld, alkali wash means for cleaning the surface of said tubing, means to prepare the surface of said tubing by exposing it to an acidic pickling solution, rinse means to remove said pickling solution from the tubing, means to dry said tubing and preheat the same, means for applying molten metal onto the surface of said formed tubing, means to cool said tubing to solidify said molten metal, a plurality of brushing means mounted adjacent the path of travel of said tubing at a location where said molten metal has solidified, said plurality of brushing means including a plurality of brushes mounted for tangential contact with said tubing and disposed around the path of said tubing to polish all portions of the surface of said tubing and a plurality of brushes mounted for radial contact with said tubing and disposed around the path of said tubing to polish all portions of the surface of said tubing, means to supply polishing abrasives to said rotating polishing brushes, and a means for rotating said polishing brushes in contact with the solidified metal surface of said traveling tubing for polishing the same, buffing means adjacent the path of travel of said tubing for contact with said traveling tubing, means to continuously supply a fine abrasive to said buffing means, and means for rotating said buffing means circumferentially around said traveling tubing for buffing said polished surface to a lustrous finish, cleaning means to clean polishing abrasives from the lustrous finish on said polished surface, chromate passivating means for rendering the lustrous surface less chemically active, means for applying a coating to said lustrous finish, means for curing said coating, and means for cutting said tubing into lengths.

2. Apparatus according to claim 1 wherein said final polishing means contact at least about 240° of the circumference of said tubing at all times.

3. A method for continuously forming tubing from metal strip and providing a decorative finish thereto as it travels along a straight-line path including, in sequence, continously supplying metal strip to a processing line and joining ends of strips to each other, forming the traveling strip into a tubular configuration with the lateral edges of said strip brought together, welding the lateral edges of said strip together, scarfing the newly formed weld to form tubing that is continuously traveling along the straight-line path, cleaning the surface of the scarfed tubing with an alkali wash, preparing the surface of said tubing by exposing it to an acidic pickling solution, rinsing said tubing with water to remove acidic pickling solution from the tubing, coating the surface of said traveling tubing by passing said tubing through a molten metal bath, cooling said just coated tubing, polishing said just coated and cooled tubing with a plurality of brushing means including a plurality of brushes mounted for tangential contact with said tubing and disposed around the path of said tubing to polish all portions of the surface of said tubing and a plurality of brushes mounted for radial contact with said tubing and disposed around the path of said tubing to polish all portions of the surface of said tubing, and supplying polishing abrasives to said brushing means to more finely polish said tubing as it moves downstream along said path, providing a final buffing means mounted adjacent the path of travel of said tubing for contact therewith, supplying an abrasive to said final buffing means, and circumferentially rotating said final buffing means around said traveling tubing to buff said polished surface to a lustrous finish, cleaning the lustrous finish of said polished surface to remove abrasives therefrom, chromate passivating the cleaned lustrous finish to render it less chemically active, coating said tubing with a layer of polymer to prevent oxidation thereof, curing said polymer coating, and cutting said tubing into lengths.

4. A method according to claim 3 supplying a polymer having sufficient elasticity to remain covering said lustrous tubing as said tubing is later bent.

5. A method according to claim 3 wherein said polymer coating is acrylic polyurethane.

* * * * *